US009548064B2

(12) United States Patent
Fujieda

(10) Patent No.: US 9,548,064 B2
(45) Date of Patent: Jan. 17, 2017

(54) NOISE ESTIMATION APPARATUS OF OBTAINING SUITABLE ESTIMATED VALUE ABOUT SUB-BAND NOISE POWER AND NOISE ESTIMATING METHOD

(71) Applicant: Oki Electric Industry Co., Ltd., Tokyo (JP)

(72) Inventor: Masaru Fujieda, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 101 days.

(21) Appl. No.: 14/615,085

(22) Filed: Feb. 5, 2015

(65) Prior Publication Data

US 2015/0230023 A1 Aug. 13, 2015

(30) Foreign Application Priority Data

Feb. 10, 2014 (JP) ..... 2014-023591

(51) Int. Cl.
*H04R 3/00* (2006.01)
*G10L 21/0208* (2013.01)
*G10L 21/0232* (2013.01)

(52) U.S. Cl.
CPC ..... *G10L 21/0232* (2013.01); *G10L 21/0208* (2013.01)

(58) Field of Classification Search
CPC ..... G10L 21/00; G10L 21/02; G10L 21/0208; G10L 21/0232; G10L 21/0216; G10L 21/038; G10L 2021/02166; G10L 19/00; G10L 19/09; G10L 19/012; G10L 19/0204; G10L 19/03; G10L 25/12;G10L 25/18; H04R 3/00; H04R 3/002; H04R 1/1083; G10K 11/002
See application file for complete search history.

(56) References Cited

U.S. PATENT DOCUMENTS 7,590,528 B2 9/2009 Kato et al.
8,107,546 B2 * 1/2012 Gao ..... H04L 1/005 375/260

(Continued)

OTHER PUBLICATIONS

Rainer Martin, "Spectral Subtraction Based on Minimum Statistics", In Proceedings of 7th European Signal Processing Conference, 1994, pp. 1182-1185.

(Continued)

*Primary Examiner* — Thang Tran
(74) *Attorney, Agent, or Firm* — Rabin & Berdo, P.C.

(57) ABSTRACT

A noise estimation apparatus of estimating a noise in an input signal includes a sub-band noise estimator estimating a noise in a sub-band input signal, obtained by dividing the input signal by sub-bands. The sub-band noise estimator includes a power calculator calculating a sub-band input power of the sub-band input signal; a probability model holder holding information on probability model; and an a posteriori probability maximizer calculating an instantaneous estimated value of a sub-band noise power based on the sub-band input power, an estimated value of the sub-band noise power and the information on the probability model, so as to maximize a posteriori probability of the sub-band noise power. The information on the probability model includes a likelihood function regarding a posteriori signal-to-noise ratio (SNR) in dependence upon predictive a posteriori SNR; and a priori probability of the a posteriori SNR under a condition establishing averaged a posteriori SNR.

19 Claims, 6 Drawing Sheets

(56) References Cited

U.S. PATENT DOCUMENTS

| | | | | |
|---|---|---|---|---|
| 2002/0029141 | A1* | 3/2002 | Cox | G10L 21/0208 704/220 |
| 2008/0159559 | A1* | 7/2008 | Akagi | G10L 21/0208 381/92 |
| 2008/0167866 | A1* | 7/2008 | Hetherington | G10L 21/0208 381/94.2 |
| 2009/0310796 | A1* | 12/2009 | Seydoux | H04M 9/082 381/71.1 |
| 2010/0076769 | A1* | 3/2010 | Yu | G10L 19/0204 704/269 |
| 2010/0100386 | A1* | 4/2010 | Yu | G10L 21/0208 704/270 |
| 2013/0003987 | A1* | 1/2013 | Furuta | G10L 21/0208 381/94.3 |
| 2013/0191118 | A1* | 7/2013 | Makino | G10L 21/0232 704/226 |

OTHER PUBLICATIONS

Mehrez Souden et al., "Noise Power Spectral Density Tracking: A Maximum Likelihood Perspective", IEEE Signal Processing Letters, vol. 19, No. 8, August 2012, pp. 495-498.

* cited by examiner

NOISE ESTIMATION APPARATUS OF OBTAINING SUITABLE ESTIMATED VALUE ABOUT SUB-BAND NOISE POWER AND NOISE ESTIMATING METHOD

BACKGROUND OF THE INVENTION

Field of the Invention

The present invention relates to a noise estimator and a noise estimating method, for instance, which are applied to a noise suppressor or a speech enhancer for suppressing a noise added onto speech by frequency domain process.

Description of the Background Art

Because noise are present all around natural environments, sounds generally observed in the practical world includes the noises coming from various sources. To enhance the speech from input signals consisting of the speech and the noises, various methods of suppressing the noises are developed. Almost all those methods estimate the noise to be suppressed and then suppress the noise included in the input signals. The invention relates to the noise estimation, particularly to intend estimating power of the noise in the frequency domain.

The simplest conventional noise estimating method averages input spectra within speech absent periods. However, this method needs to estimate the speech absent periods in advance. On the other hand, a technique of estimating speech active periods, such as voice activity detection (VAD), is actively researched, but a perfect VAD is not yet achieved. An estimation error of the speech active periods involves the speech in the estimated noise. As a result, a problem of distorting the enhanced speech and remained noise is occurred. In such a method, because the noise is estimated only in the noise periods, the noise may not be estimated according to noise variation in a long speech active period.

By contrast, other noise estimating methods of estimating the noise consecutively even in the speech active periods are developed, for example, as referred to in Rainer Martin, "Spectral Subtraction Based on Minimum Statistics", in Proceedings of 7th European Signal Processing Conference, 1994, pp. 1182-1185, and in Mehrez Souden et al., "Noise Power Spectral Density Tracking: A Maximum Likelihood Perspective", IEEE Signal Processing Letters, Vol. 19, No. 8, August 2012, pp. 495-498, as well as in U.S. Pat. No. 7,590,528 B1 to Kato et al. With regard to a conventional noise suppressor applying the noise suppressing methods taught by Martin, Souden et al., and Kato et al., its configuration and operations will be briefly illustrated below.

The conventional noise suppressor includes a sub-band divider for dividing an input signal into sub-band input signals, sub-band processors as many as the number of the divided sub-band input signals for processing the divided sub-band signals (for example, when the input signal is divided into 256 sub-band input signals, the number of sub-band processors included in the noise suppressor is 256) and a signal reconstructor for reconstructing a temporal waveform on the basis of the sub-band enhanced signals processed by the sub-band processors.

The sub-band divider divides an input signal into K (e.g. K is equal to 256) sub-bands by an optional sub-band division way, such as a filter bank, or an optional frequency analysis way, such as Fourier transform, to respectively transmit the resultant K sub-band input signals to the sub-band processors. A digital signal such as the input signal may be processed for each sample or, if necessary, processed for each frame, e.g. at 10 milliseconds intervals. Hereinafter, this specification may describe various signals and various components so that the words "signal" and "component" are omitted.

The sub-band processors carry out processes in respective different sub-bands. However, the processes for the sub-bands perform much the same. The respective sub-band processors include a sub-band noise estimator and a noise suppressor. The sub-band noise estimator estimates the noise power for each sub-band to transmit the resultant sub-band noise power to the noise suppressor. The noise suppressor enhances the speech component in the sub-band input signal on the basis of the sub-band input signal and the sub-band noise power to transmit the resultant sub-band enhanced signal to the signal reconsturctor.

The signal reconstructor reconstructs temporal waveformat from the sub-band enhanced signal by a signal decoding way corresponding to the sub-band division way or frequency analysis way used in the sub-band divider to output the resultant enhanced signal.

Now, a conventional noise estimating method carried out in the sub-band noise estimator will be described below in detail. The sub-band noise estimator corresponds to, for example, the noise suppressing method taught by Martin, Souden et al., and Kato et al. In the following, for simplification, the sub-band input signal power and the sub-band noise power are called as an "input power" and a "noise power", respectively. Furthermore, the sub-band number is omitted.

The noise estimating method taught by Martin is based on a discovery that a peak in the time direction of the input power indicates an existence of the object speech, and that valley information in the time direction of the input power is useful for estimation of smoothed noise power. For instance, a minimum value of the input power from the present time to a predetermined time (T second) before is determined as a first estimated value of the noise power. However, the first noise power estimated value has a bias, and accordingly, has a characteristic becoming smaller than a true noise power. This bias is estimated on the basis of an expected value of the first estimated value. By correcting the first estimated value using the resultant bias estimated value, a second estimated value (a final estimated value) of the noise power is obtained.

The noise estimating method taught by Souden et al., is on the basis of the hypothesis that both distributions of complex spectra of the object speech and noise depend on complex normal distribution averaged to zero, to determine the Maximum Likelihood (ML) estimate of dispersion of the complex spectrum of the noise as the estimated value of the noise power. On the basis of the hypothesis, the distribution of the complex spectrum of the input signal is determined as complex normal distribution averaged to zero having the sum of dispersions of the complex spectra of the speech and noise. In the method, a hidden variable relating to whether the present input is a degraded signal or the noise can be introduced. Furthermore, an online Expectation Maximization (EM) algorithm with forgetting coefficient is applied. Accordingly, the ML estimate of the complex spectrum of the noise can be calculated.

In the noise estimating method taught by Kato et al., the input power is multiplied by a suitable weight coefficient. The resultant weighted input power is stored for a predetermined time (T second). An average of stored weighted input power is determined as the estimated value of the noise power. The suitable weight coefficient is calculated by a posteriori signal-to-noise ratio (SNR), which is determined by dividing the present input power by the previous estimated value of the noise power. For instance, the weight coefficient is determined as 1 when the a posteriori SNR is a predetermined value G1 or less, and so as to be inversely proportional to the a posteriori SNR when the a posteriori SNR is greater than the predetermined value G1. Moreover, the weight coefficient is determined as zero when the a posteriori SNR is greater than another predetermined value G2. If the weight coefficient is zero, the weighted input power is not stored.

However, in the conventional noise estimating method, there are problems as mentioned below. In the noise estimating method taught by Martin, there is a problem that the unpleasant noise is remained by the noise suppression at the latter step when the noise is rapidly increased. For instance, the estimated value of the noise power is kept small for a predetermined time after the noise begins to increase. When the predetermined time is elapsed after the noise is increased, the estimated value of the noise power is rapidly increased. If the estimated value is used for the noise suppressing method, the remained noise is rapidly increased at the moment the noise is increased, and then, the remained noise is rapidly decreased after the predetermined time. The rapid variation of volume of the remained noise gives auditors unpleasantness on auditory sensation.

In the noise estimating method taught by Mehrez Souden et al., there is a problem that the estimated value of the noise power is over- and under-estimation, if a noise level is varied. The online EM algorithm used in the noise estimating method has trade-off between quickness of the convergence and stability of the ML estimation, as described below. When the forgetting coefficient is increased, the stability is improved and the convergence is slowed. On the contrary, the forgetting coefficient is decreased, the convergence is speeded up and the stability is deteriorated. As a result, regardless of the increase or decrease of the forgetting coefficient, the estimated value of the noise power is incorrect. In the noise suppressing method at the latter step, the distortion of the enhanced speech is increased and the remained noise is increased.

In the noise estimating method taught by Masanori Kato et al., the estimated value of the noise power is relatively less to follow the speech in mistake and become instability by following non-stationary noise. Moreover, this method may relatively immediately follow the noise variation. However, in the noise period after the speech active periods with the weight coefficient not becoming zero are continued, the estimated value of the noise power rapidly decreases after approximately T second from switching from the successive speech active periods to the noise period. If the estimated value is used for the noise suppressing method at the latter step, the enhanced signal becomes unnatural on the auditory sensation. This is because the remained noise rapidly increases in the noise period.

As mentioned above, the conventional noise estimating methods have the problems that the estimated value of the noise power becomes instability and rapidly varies.

SUMMARY OF THE INVENTION

It is therefore an object of the present invention to provide a noise estimator and a noise estimating method capable of stably estimating the noise power.

In accordance with the present invention, a noise estimation apparatus of estimating a noise contained in an input signal includes at least one sub-band noise estimator estimating a noise included in a sub-band input signal, obtained by dividing the input signal by sub-bands. The sub-band noise estimator comprises: a power calculator calculating a sub-band input power of the sub-band input signal; a probability model holder holding information on probability model obtained by modelizing stationarity of the noise; and an a posteriori probability maximizer calculating an instantaneous estimated value of a sub-band noise power on the basis of the sub-band input power, an estimated value of the sub-band noise power outputted from the sub-band noise estimator and the information on the probability model held in the probability model holder, so as to maximize a posteriori probability of the sub-band noise power. The information on the probability model includes information on: a likelihood function with regard to a posteriori signal-to-noise ratio (SNR) on the basis of predictive a posteriori SNR; and a priori probability of the a posteriori SNR under a condition where averaged a posteriori SNR is established.

Moreover, in accordance with the invention, a noise estimating method of estimating a noise contained in an input signal includes a step of estimating a noise contained in a sub-band input signal obtained by dividing the input signal by sub-bands. The step of estimating the noise further includes sub-steps of: calculating a sub-band input power of the sub-band input signal; and holding information on probability model obtained by modelizing stationarity of the noise. The information on the probability model includes information on: a likelihood function with regard to a posteriori signal-to-noise ratio (SNR) on the basis of predictive a posteriori SNR; and a priori probability of the a posteriori SNR under a condition where averaged a posteriori SNR is established. The step of estimating the noise further includes sub-steps of calculating an instantaneous estimated value of a sub-band noise power on the basis of the sub-band input power, an estimated value of the sub-band noise power and the held information on the probability model, so as, to maximize a posteriori probability of the sub-band noise power.

Furthermore, in accordance with the invention, a non-transitory computer-readable medium stores a noise estimating program for causing a computer to serve as a sub-band noise estimator estimating a noise included in a sub-band input signal obtained by dividing an input signal inputted to the computer by sub-bands. The program further causes the computer to serve as the sub-band noise estimator including: a power calculator calculating a sub-band input power of the sub-band input signal; a probability model holder holding information on probability model obtained by modelizing stationarity of the noise; and an a posteriori probability maximizer calculating an instantaneous estimated value of a sub-band noise power on the basis of the sub-band input power, an estimated value of the sub-band noise power outputted from the sub-band noise estimator and the information on the probability model held in the probability model holder, so as to maximize a posteriori probability of the sub-band noise power. The information on the probability model includes information on: a likelihood function with regard to a posteriori signal-to-noise ratio (SNR) on a basis of predictive a posteriori SNR; and a priori probability of the a posteriori SNR under a condition where averaged a posteriori SNR is established.

According to the present invention, it is possible to provide a noise estimation apparatus, a noise estimating method and a non-transitory computer-readable medium storing a noise estimating program, which can stably estimate the estimated value of the sub-band noise power.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENTS

Figure 1:
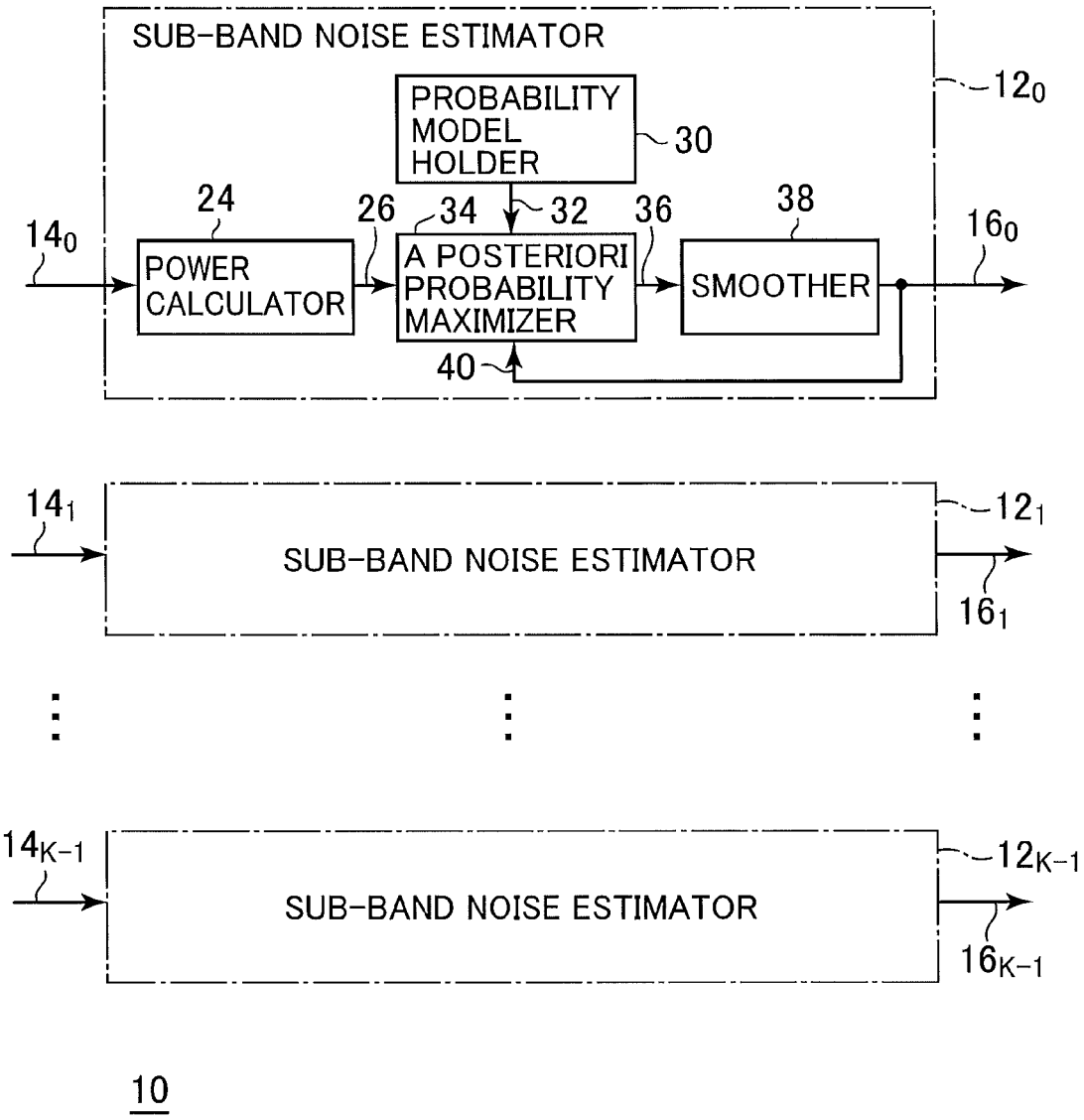
FIG. 1 is a schematic block diagram showing sub-band noise estimators included in a noise estimator according to an embodiment of the present invention.

Previous to the description of embodiments of the present invention, an idea of approaching the embodiments and the grounds for actualizing stable estimation of noise power with the embodiments will be described.

In the following, power of a sub-band input signal will be called as input power or sub-band input power. Furthermore, power of a noise estimated for respective sub-bands will be called as noise power or sub-band noise power. In the description, the sub-band number is omitted in principle. However, a noise estimating method described below is executed for the respective sub-bands. That is, although processes for the respective sub-bands are similar to each other, the sub-band input signal to be input and an estimated value of the noise power to be output are different for each sub-band.

The most important point to be noted in the noise estimating method is to prevent an object speech from being included into the noise estimated value. If the object speech is included into the noise estimated value, an enhanced signal obtained by a noise suppression process at the latter step is distorted and attenuates. As a result, the noise suppression process may not achieve objectives of improving clearance and word intelligibility of the enhanced signal.

In the noise estimation, a performance capable of estimating not only stationary noise but also non-stationary noise may be required. However, because it is difficult to distinguish the non-stationary noise from the speech, it may be impossible to avoid trade-off between the performance of estimating the non-stationary noise and performance of not including the speech into the noise estimated value. As a consequence, conventionally, there were problems that the noise estimating method with high stability merely estimated the stationary noise and that the noise estimating method capable of estimating the non-stationary noise made the speech included into the noise estimated value to deteriorate the stability.

In order to actualize the noise estimation with higher stability, the embodiments according to the present invention restrict estimation object to the stationary noise. To the noise estimation, a framework of maximum a posteriori (MAP) estimation is applied. The stationarity of the noise means that probability distribution (probability density function) of the noise does not vary according to a time.

As the problem of estimating the stationary noise, it is considered that the present noise power $N_t$ at a time t is calculated so as to maximize a posteriori probability of the noise power $N_t$ under a condition where the past noise powers $N_{t-1}, N_{t-2}, \ldots$, have been observed. By setting the problem, it is possible to introduce the stationarity of the noise later. Since the power is easily treated in a logarithm scale, a logarithmic sub-band noise power of $\hat{N}_t=10\log_{10}N_t$ will be considered hereinafter. Although logarithmic conversion is performed so that a unit of the logarithmic sub-band noise power becomes a decibel as abase of the logarithm, a Napier's constant or 2 may be utilized. Furthermore, calculation result of the logarithm may be not necessarily multiplied by 10 or may be multiplied by another optional constant coefficient instead of 10.

In the logarithmic sub-band noise power $N_t$, degree of freedom may be remained with regard to a volume of a sound varying in accordance with to sound collection environment and microphone sensitivity. In order to normalize or cancel this degree of freedom, instead of the logarithmic sub-band noise power, a posteriori SNR is used, the a posteriori SNR being determined by subtracting the logarithmic sub-band noise power from a logarithmic sub-band input power, i.e. by dividing the input power by the noise power.

The a posteriori SNR, which is indicated by the term $\hat{\gamma}_t$, at a time t as an estimation object is expressed by following numerical Expression (1), where the logarithmic sub-band input power is indicated by $\hat{X}_t$:

$$\hat{\gamma}=\hat{X}_t-\hat{N}_t \qquad \text{Expression (1).}$$

In order to introduce the stationarity of the noise, predictive a posteriori SNR $\gamma_{t|t-m}$ is introduced. The predictive a posteriori SNR $\gamma_{t|t-m}$ is determined by subtracting the past logarithmic sub-band noise power $\hat{N}_{t-m}$ before a predetermined time m from the logarithmic sub-band input power $\hat{X}_t$ at the time t and expressed by Expression (2):

$$\hat{\gamma}_{t-m}=\hat{X}_t-\hat{N}_{t-m} \qquad \text{Expression (2).}$$

A time difference m may be optically determined. Most preferably, a value of an immediately preceding frame, more specifically, the logarithmic sub-band noise power $\hat{N}_{t-1}$ in a case of m=1 may be used.

Furthermore, past averaged a posteriori SNR $\bar{\gamma}_{t-1}$ expressed by Expression (3) is introduced:

$$\bar{\gamma}_{t-1}=E\{\hat{\gamma}_t|\tau=t-1, t-2, \ldots\} \qquad \text{Expression (3).}$$

An intention of introducing the averaged a posteriori SNR $\bar{\gamma}_{t-1}$ is to incorporate, into a calculation model, a fact that potential distribution of the a posteriori SNR is affected by magnitude of a noise level in the sound collection. For instance, the a posteriori SNR of 20 dB to 30 dB is often obtained in an environment where the noise is hardly generated, such as an anechoic chamber, but hardly obtained in a rough environment where the speech can hardly be caught, such as a construction site.

When three a posteriori SNRs as mentioned above are used, the a posteriori probability to be maximized is determined as a probability generating the a posteriori SNR $\hat{\gamma}_t$ under a condition where the predictive a posteriori SNR $\hat{\gamma}_{t|t-m}$ and the past averaged a posteriori SNR $\bar{\gamma}_{t-1}$ are established. The a posteriori probability to be maximized is expressed in a left side of a following numerical Expression (4):

$$p(\hat{\gamma}_t \mid \hat{\gamma}_{t|t-m}, \bar{\gamma}_{t-1}) = \frac{p(\hat{\gamma}_{t|t-m} \mid \hat{\gamma}_t, \bar{\gamma}_{t-1})p(\hat{\gamma}_t \mid \bar{\gamma}_{t-1})p(\bar{\gamma}_{t-1})}{p(\hat{\gamma}_{t|t-m}, \bar{\gamma}_{t-1})}. \quad \text{Expression (4)}$$

When the determined probability is expanded on the basis of Bayes' theorem, a right side of the above Expression (4) is obtained.

Because the maximization of the Expression (4) is solved in terms of the a posteriori SNR $\hat{\gamma}_t$, the denominator of the right side of the Expression (4) does not affect the maximization. The term of $p(\bar{\gamma}_{t-1})$ in the right side means a potential probability of the noise level in the sound collection. However, since the environment where the sound collection is carried out is generally indefinite, uniform distribution is assumed. Thus, the preferable a posteriori probability is derived by maximizing multiplication values of two anterior probabilities in a numerator of the right side which represents multiplication of three probabilities in the Expression (4).

Moreover, it is considered that, in the MAP estimation, there are a lot of cases where the logarithmic a posteriori probability is maximized easier than a linear a posteriori probability. By applying such a consideration, cost function $J_{map}(\hat{\gamma}_t)$ for calculating an optimum value of the a posteriori SNR $\hat{\gamma}_t$ is defined by following Expression (5):

$$J_{map}(\hat{\gamma}_t)=\log p(\hat{\gamma}_{t|t-m}|\hat{\gamma}_t,\bar{\gamma}_{t-1})+\log p(\hat{\gamma}_t|\bar{\gamma}_{t-1}) \quad \text{Expression (5).}$$

The first term of the right side in the above Expression (5) is a logarithmic likelihood function of the a posteriori SNR $\hat{\gamma}_t$. The first term further represents a relationship between the present a posteriori SNR $\hat{\gamma}_t$ (at the time t) and the a posteriori SNR $\hat{\gamma}_{t|t-m}$ determined by subtracting the past logarithmic sub-band noise power $\hat{N}_{t-m}$ before the predetermined time from the present logarithmic sub-band input power $\hat{X}_t$.

This relationship can be rephrased as described below. The first term expresses a relationship between the present logarithmic sub-band noise power $\hat{N}_t$ and the past logarithmic sub-band noise power $\hat{N}_{t-m}$ before the time difference m. Therefore, the first term expresses the stationarity of the noise. The first term includes the past averaged a posteriori SNR $\bar{\gamma}_{t-1}$ before one unit time as a condition. However, in the logarithmic scale, since it is considered that characteristic of the stationarity of the noise is independent of the past averaged a posteriori SNR $\bar{\gamma}_{t-1}$, the characteristic is not varied according to the time. This is based on the facts that a time variation amount of the noise power in a linear scale is proportional to the past averaged a posteriori SNR but that a time variation rate of the logarithmic noise power is taken into account in the logarithm scale. Therefore, the Expression (5) can be altered as following Expression (6):

$$J_{map}(\hat{\gamma}_t)=\log p(\hat{\gamma}_{t|t-m}|\hat{\gamma}_t)+\log p(\hat{\gamma}_t|\bar{\gamma}_{t-1}) \quad \text{Expression (6).}$$

The second term of the right side in the above Expression (6) represents logarithmic a priori probability of the present a posteriori SNR $\hat{\gamma}_t$ under a condition of the past averaged a posteriori SNR $\bar{\gamma}_{t-1}$. More specifically, the second term represents an appearance probability of the present a posteriori SNR $\hat{\gamma}_t$ in the sound collection environment with the averaged a posteriori SNR $\bar{\gamma}_{t-1}$.

The logarithmic likelihood function and the logarithmic a priori probability serve to restrain and correct mutual excessive optimization as mentioned below. If only the logarithmic likelihood function indicating the stationarity is used for the optimization, the a posteriori SNR is not updated. This is because its optimum solution becomes a value of $\hat{\gamma}_t=\hat{\gamma}_{t|t-m}$ having highest stationarity. If only the logarithmic a priori probability indicating the innate appearance probability is used for the optimization, the stationarity is not taken into account. This is because its optimum solution becomes a value of $\hat{\gamma}_t$ making the logarithmic a priori probability highest always. By contrast, when the noise is estimated by the above Expression (6), it is possible to obtain suitable solution without excessive. This is because both stationarity and innate appearance probability are satisfied by using the Expression (6).

Now, an optimum solution of the Expression (6) is assumed as $\hat{\gamma}^*_t$. When the present (logarithmic) sub-band input power $\hat{X}_t$ together with the optimum solution $\hat{\gamma}^*_t$ is applied to the Expression (1), the logarithmic sub-band noise power $\hat{N}^*_t$ applying the optimum solution can be obtained as expressed by following Expression (7):

$$\hat{N}_t^*=\hat{X}_t-\hat{\gamma}_t^* \quad \text{Expression (7).}$$

As described above, between the sub-band noise power $N_t$ and logarithmic sub-band noise power $\hat{N}_t$, there is a relationship of $\hat{N}_t=10\log_{10}N_t$. By substituting this relationship expression in the Expression (7), the estimated value $N^*_t$ or an optimum value $N^*_t$ of the sub-band noise power is expressed by following Expression (8):

$$N_t^*=10\hat{N}_t^*/10 \quad \text{Expression (8).}$$

The above Expression (8) assumes that the unit of the logarithmic sub-band noise power $\hat{N}_t$ is the decibel. However, if the logarithmic conversion is performed in another way as mentioned above, another expression using values of abase and a constant multiplication corresponding to the other way is applied, instead of the Expression (8).

However, the estimated value $N^*_t$ of the sub-band noise power derived by the Expression (8) has an instantaneous estimated error. The estimated value $\hat{N}^*_t$ of the logarithmic sub-band noise power expressed by the Expression (7) also has a similar error. Although removal of the instantaneous estimated error is not always required, an influence of the instantaneous estimated error can be reduced by temporally-smoothing the estimated value. Thereupon, the estimated value $N^*_t$ of the sub-band noise power obtained by the MAP estimation is assumed as an instantaneous estimated value of the sub-band noise power and temporally-smoothed, thereby obtaining a final estimated value $\bar{N}^*_t$ of the sub-band noise power.

The temporally-smoothing method is not restricted. For example, the temporally-smoothing method may calculate an averaged value of the instantaneous estimated value $N^*_t$ of the sub-band noise power over a predetermined last short period as expressed by following Expression (9):

$$\overline{N}_t^* = \frac{1}{T}\sum_{i=t-T+1}^{t} N_t^*. \quad \text{Expression (9)}$$

Otherwise, the temporally-smoothing method may calculate a weighted addition value of the last smoothed value $\bar{N}^*_{t-1}$ and an optimum value $N^*_{t-1}$ of the present sub-band noise power as expressed by following Expression (10):

$$\bar{N}_t^* = \alpha \bar{N}_{t-1}^* + (1-\alpha) N_t^*,\ 0<\alpha<1 \qquad \text{Expression (10)},$$

where a term $\alpha$ indicates a weighted coefficient which is larger than 0 and smaller than 1.

Although, a case of temporally-smoothing the instantaneous estimated value $N^*_t$ of the sub-band noise power is described above, an instantaneous estimated value $\hat{N}^*_t$ of the logarithmic sub-band noise power may be temporally-smoothed. In such a case, an estimated value of the logarithmic sub-band noise power obtained by the temporal smoothing is converted to a linear scale by using the above Expression (8), thereby obtaining the estimated value $\bar{N}^*_t$ of the sub-band noise power.

Next, a specific functional form of the likelihood function and the a priori probability for defining the cost function $J_{map}(\hat{\gamma}_t)$ expressed by the above Expression (6) will be described. The functional form will be called as probability model information in the after-mentioned embodiments.

The likelihood function $p(\hat{\gamma}_{t|t-m}|\hat{\gamma}_t)$ can be rewritten as $p(\hat{X}_t-\hat{N}_{t-m}|\hat{X}_t-\hat{N}_t)$ by substituting the Expressions (1) and (2) for the likelihood function. When the rewritten likelihood function is compared as a function of $p(\hat{N}_{t-m}|\hat{N}_t)$ if one function is mathematically operated so that signs of the logarithmic sub-band noise powers $\hat{N}_{t-m}$ and $\hat{N}_t$ are inverted and then shifted in parallel, the operated result becomes equal to the other function. Accordingly, both probability density functions have the similar distribution shape. Therefore, the function of $p(\hat{N}_{t-m}|\hat{N}_t)$ may be applied instead of the function of $p(\hat{\gamma}_{t|t=m}|\hat{\gamma}_t)$.

The function of $p(\hat{N}_{t-m}|\hat{N}_t)$ corresponds with the appearance probability of the past logarithmic sub-band noise powers $\hat{N}_{t-m}$ before time difference m or m frames under the condition where the present logarithmic sub-band noise powers $\hat{N}_t$ is established. Taking the stationarity into account, greatest probability is obtained in a case where the power have a relationship of $\hat{N}_{t-m}=\hat{N}_t$. The probability becomes small in proportion as the past logarithmic sub-band noise powers $\hat{N}_{t-m}$ is separated from the present logarithmic sub-band noise powers $\hat{N}_t$. That is to say, if $|\hat{N}_{t-m}-\hat{N}_t|$ approaches infinite, the function of $p(\hat{N}_{t-m}|\hat{N}_t)$ converges to zero. Thus, the likelihood function $p(\hat{N}_{t-m}|\hat{N}_t)$ of the logarithmic sub-band noise powers $\hat{N}_t$ is the probability density function with a symmetrical peaked pattern.

A normal distribution is representative of the probability density function with the symmetrical peaked pattern. The likelihood function $p(\hat{N}_{t-m}|\hat{N}_t)$ of the logarithmic sub-band noise power $\hat{N}_t$ modelized by using the normal distribution, i.e. the probability density function with the condition of the power $N_{t-m}$, is expressed by following Expression (11):

$$p(\hat{N}_{t-m}|\hat{N}_t) = \frac{1}{\sqrt{2\pi\sigma^2}}\exp\left\{-\frac{(\hat{N}_{t-m}-\hat{N}_t)^2}{2\sigma^2}\right\}, \qquad \text{Expression (11)}$$

where a distribution parameter representing strength of the stationarity in the normal distribution is indicated by a symbol $\sigma^2$, $\sigma^2$ may being equal to 42, for example.

As the likelihood function $p(\hat{N}_{t-m}|\hat{N}_t)$, the generalized normal distribution being a greatly flexible model may be chosen. In such a case, the function $p(\hat{N}_{t-m}|\hat{N}_t)$ is expressed by following Expression (12):

$$p(\hat{N}_{t-m}|\hat{N}_t) = \frac{\beta}{2\alpha\Gamma(1/\beta)}\exp\left\{-\left(\frac{|\hat{N}_{t-m}-\hat{N}_t|}{\alpha}\right)^\beta\right\}, \qquad \text{Expression (12)}$$

where a factor $\Gamma(.)$ indicates the gamma function and where and factors $\alpha$ and $\beta$ indicate parameters for determining the characteristics of the stationarity, $\alpha$ and $\beta$ may being equal to 7.6 and 1.9, respectively, for example.

Instead of the above-mentioned instances, an optional probability density function of satisfying the following condition may be chosen as the likelihood function $p(\hat{N}_{t-m}|\hat{N}_t)$. In the probability density function, if the power $\hat{N}_{t-m}$ is equal to the power $\hat{N}_t$, greatest probability is obtained. Moreover, if $|\hat{N}_{t-m}-\hat{N}_t|$ approaches infinite, the function of $p(\hat{N}_{t-m}|\hat{N}_t)$ converges to zero.

The likelihood function $p(\hat{\gamma}_{t|t-m}|\hat{\gamma}_t)$ expressed by the a posteriori SNR can be obtained by deforming the variable $\hat{N}_{t-m}-\hat{N}_t$ in the above Expressions (11) and (12), which variable corresponds with the logarithmic sub-band noise power, as expressed by following Expression (13):

$$\hat{N}_{t-m}-\hat{N}_t=\hat{N}_{t-m}-\hat{X}_t-(\hat{N}_t-\hat{X}_t)=-\hat{\gamma}_{t|t-m}+\hat{\gamma}_t=\hat{\gamma}_t-\hat{\gamma}_{t|t-m} \qquad \text{Expression (13)}.$$

Now, the a priori probability $p(\hat{\gamma}_t|\bar{\gamma}_{t-1})$ that the present a posteriori SNR $\hat{\gamma}_t$ is obtained under the condition of the past averaged a posteriori SNR $\bar{\gamma}_{t-1}$ for defining the cost function $J_{map}(\hat{\gamma}_t)$ expressed by the Expression (6) will be described below.

First, a range of values which the present a posteriori SNR $\hat{\gamma}_t$ can take will be mentioned below. Because the input signal includes both the speech and noise, the logarithmic sub-band input power $\hat{X}_t$ is not smaller than the logarithmic sub-band noise power $\hat{N}_t$. The a posteriori SNR $\hat{\gamma}_t$ expressed by the Expression (1) is therefore non-negative.

Second, sparseness of the speech will be described. The sparseness of the speech is the property that the speech is not dense in the time-frequency-domain. Generally, because time-frequency representation of the speech is sparse, the logarithmic sub-band input power $\hat{X}_t$ often becomes equal to the logarithmic sub-band noise power $\hat{N}_t$. The appearance probability is therefore highest when the a posteriori SNR $\hat{\gamma}_t$ is equal to zero dB.

Third, the appearance probability in the high SNR will be described. Since the volume of the speech is limited, the logarithmic sub-band input power $\hat{X}_t$ is also limited. By contrast, since the noise has low sparseness compared with the speech, the logarithmic sub-band noise power $\hat{N}_t$ hardly becomes small. The a priori probability $p(\hat{\gamma}_t|\bar{\gamma}_{t-1})$ therefore converges to zero, in proportion as the a posteriori SNR $\hat{\gamma}_t$ approaches infinite.

When the above three matters are considered, as one of candidates for the a priori probability $p(\hat{\gamma}_t|^{31}\ \gamma_{t-1})$ of the present a posteriori SNR $\hat{\gamma}_t$ obtained under the condition of the past averaged a posteriori SNR $\bar{\gamma}_{t-1}$, the exponential distribution expressed by following Expression (14) can be naturally chosen. However, the a priori probability may not be restricted to the exponential distribution as mentioned later.

$$p(\hat{\gamma}_t|\bar{\gamma}_{t-1})=\lambda_t\exp(-\lambda_t\hat{\gamma}_t) \qquad \text{Expression (14)}$$

In the Expression (14), the symbol of $\lambda_t$ is a parameter of representing a spread of the distribution. As the value of $\lambda_t$ becomes smaller, the spread of the distribution becomes larger. As the averaged a posteriori SNR $\bar{\gamma}_{t-1}$ becomes larger, the present a posteriori SNR $\hat{\gamma}_t$ easily becomes larger. The parameter $\lambda_t$ is therefore determined so as to be inversely proportional to the averaged a posteriori SNR $\bar{\gamma}_{t-1}$ or to have negative correlation to the averaged a posteriori SNR $\bar{\gamma}_{t-1}$. For instance, the parameter $\lambda_t$ is calculated according to a following numerical Expression (15):

$$\lambda_t = \frac{1}{2\bar{\gamma}_{t-1} + 10}. \quad \text{Expression (15)}$$

Although, in the foregoing, it is described that the exponential distribution can be applied as the a priori probability $p(\hat{\gamma}_t|\bar{\gamma}_{t-1})$ an optional probability density function of satisfying the three above-mentioned conditions may be also chosen as the a priori probability instead of the exponential distribution. For instance, the gamma distribution, a one-sided normal distribution or a flexible one-sided generalized normal distribution may be applied.

Now, a way of determining the optimum solution $\hat{\gamma}^*_t$ of the cost function $J_{map}(\hat{\gamma}_t)$ expressed by the Expression (6) will be described. The cost function $J_{map}(\hat{\gamma}_t)$ takes a maximum value, when the a posteriori SNR $\bar{\gamma}_t$ is equal to the optimum solution $\hat{\gamma}^*_t$. It is therefore preferable to determine the optimum solution $\hat{\gamma}^*_t$ so that the right side of the Expression (6) is differentiated with the present a posteriori SNR $\hat{\gamma}_t$ to take zero.

In the cost function $Jmap(\hat{\gamma}_t)$ expressed by the Expression (6), when the normal distribution expressed by the Expression (11) is applied to the likelihood function and when the exponential distribution expressed by the Expression (14) is applied to the a priori probability, the optimum solution $\hat{\gamma}^*_t$ is determined as expressed by a following Expression (16):

$$\hat{\gamma}_t^* = \max\{\hat{\gamma}_{t|t-m} - \lambda_t\sigma^2, 0\} \quad \text{Expression (16).}$$

Alternatively, when the generalized normal distribution expressed by the Expression (12) is applied to the likelihood function and when the exponential distribution expressed by the Expression (14) is applied to the a priori probability, the optimum solution $\hat{\gamma}^*_t$ is determined as expressed by a following Expression (17):

$$\hat{\gamma}_t^* = \max\left\{\hat{\gamma}_{t|t-m} - \left(\frac{\alpha^\beta\lambda_t}{\beta}\right)^{\frac{1}{\beta-1}}, 0\right\}. \quad \text{Expression (17)}$$

In the above Expressions (16) and (17), the term of max{a, b} represents a function choosing larger one of the parameters a and b. The term of max{a, b} is introduced to actualize the non-negative.

In either of the Expressions (16) and (17), the optimum solution $\hat{\gamma}^*_t$ is determined by subtracting a certain value from the predictive a posteriori SNR $\hat{\gamma}_{t|t-m}$. That is, when the coefficient $\hat{r}_t$ represents a logarithm of a coefficient $r_t$ as expressed by following Expression (18) and when the coefficient $\hat{r}_t$ is determined as following Expressions (19) and (20) with regard to the above Expressions (16) and (17), respectively, both the Expressions (16) and (17) can be expressed by following Expression (21):

$$\hat{\gamma}_t = 10\log_{10}\gamma_t; \quad \text{Expression (18)}$$

$$\hat{\gamma}_t = \lambda_t\sigma^2; \quad \text{Expression (19)}$$

$$\hat{\gamma}_t\left(\frac{\alpha^\beta\lambda_t}{\beta}\right)^{\frac{1}{\beta-1}}; \text{ and} \quad \text{Expression (20)}$$

$$\hat{\gamma}_t^* = \max\{\hat{\gamma}_{t|t-m} - \hat{\gamma}_t, 0\}. \quad \text{Expression (21)}$$

On the basis of the Expressions (7) and (21), the instantaneous estimated value $\hat{N}^*_t$ of the logarithmic sub-band noise power can be calculated by following Expression (22):

$$\hat{N}_t^* = \min\{\hat{N}_{t-m} + \hat{r}_t, \hat{X}_t\} \quad \text{Expression (22).}$$

Moreover, on the basis of the Expression (22) and a conversion expression from the logarithm scale to the linear scale, e.g. the Expression (18), the instantaneous estimated value $N^*_t$ of the sub-band noise power can be calculated by a following Expression (23):

$$N_t^* = \min\{r_t \cdot N_{t-m}, X_t\} \quad \text{Expression (23).}$$

In the Expressions (22) and (23), the term of min{a, b} represents a function choosing smaller one of the parameters a and b.

As expressed by the Expression (23), the instantaneous estimated value of the sub-band noise power is always increased at a suitable rate with regard to the past averaged a posteriori SNR, but does not become larger than the sub-band input power. Due to such a continuous increase and an upper limit, if the sound collection environment is gradually changed or the noise is rapidly decreased, the instantaneous estimated value of the sub-band noise power can be immediately followed. By contrast, if the noise is rapidly increased, because the averaged a posteriori SNR becomes large just after the change of the environment, the following may be delayed. However, the instantaneous estimated value of the noise power can be continuously increased to be gradually adapted to the environment.

Because the Expression (23) includes the unsmooth min function, the estimated value may be varied with short quick steps. The variation with short quick steps causes unnaturalness on the auditory sensation. It is therefore preferable, as expressed by the Expressions (9) and (10), to temporally-smooth the estimated value. That is, by temporally-smoothing the estimated value, more natural and stable estimated value of the sub-band noise power can be obtained.

In the following, a noise estimator and a noise estimating method according to an embodiment of the invention will be described with reference to the drawings. With respect to the constitution of the embodiment shown in FIG. 1, a noise estimation apparatus 10 includes a plurality of sub-band noise estimators (estimating devices) $\mathbf{12}_0$-$\mathbf{12}_{K-1}$. The number (which is indicated by a positive integer number K) of the sub-band noise estimators 12 included in the noise estimation apparatus 10 is equal to the dividing number of the sub-bands. To the sub-band noise estimators 12, different sub-band input signals are respectively inputted. The respective sub-band noise estimators 12 can have the similar functional structure to each other.

FIG. 1 is the functional block diagram showing the noise estimation apparatus 10 of the embodiment, in particular the sub-band noise estimators 12 constituting the noise estimation apparatus 10. As described above, the respective sub-band noise estimators 12 can have the similar functional structure to each other. Thus, FIG. 1 omits the specific showing of the internal functional structure of the sub-band noise estimators $\mathbf{12}_1$-$\mathbf{12}_{K-1}$ other than estimator $\mathbf{12}_0$.

The respective sub-band noise estimators 12 receive sub-band input signals 14 from a preceding processor (not shown) according to the sub-bands which can be processed in the respective estimators 12. The sub-band noise estimator 12 estimates the noise included in the sub-band input signal 14 allocated to such estimator 12 in accordance with the above-mentioned idea. The sub-band noise estimators 12 further supply a signal 16 on an estimated value of the sub-band noise power to another processor (not shown) such as a signal reconstructor and an after-mentioned signal converter.

As in the case of the embodiment shown in FIG. 1, if input signals $\mathbf{14}_0$-$\mathbf{14}_{K-1}$ distinguished for each sub-band are received from a processor (not shown) arranged at a stage prior to the noise estimation apparatus 10, the sub-band input signals $\mathbf{14}_0$-$\mathbf{14}_{K-1}$ are respectively transmitted to the sub-band noise estimators $\mathbf{12}_0$-$\mathbf{12}_{K-1}$.

Figure 2:
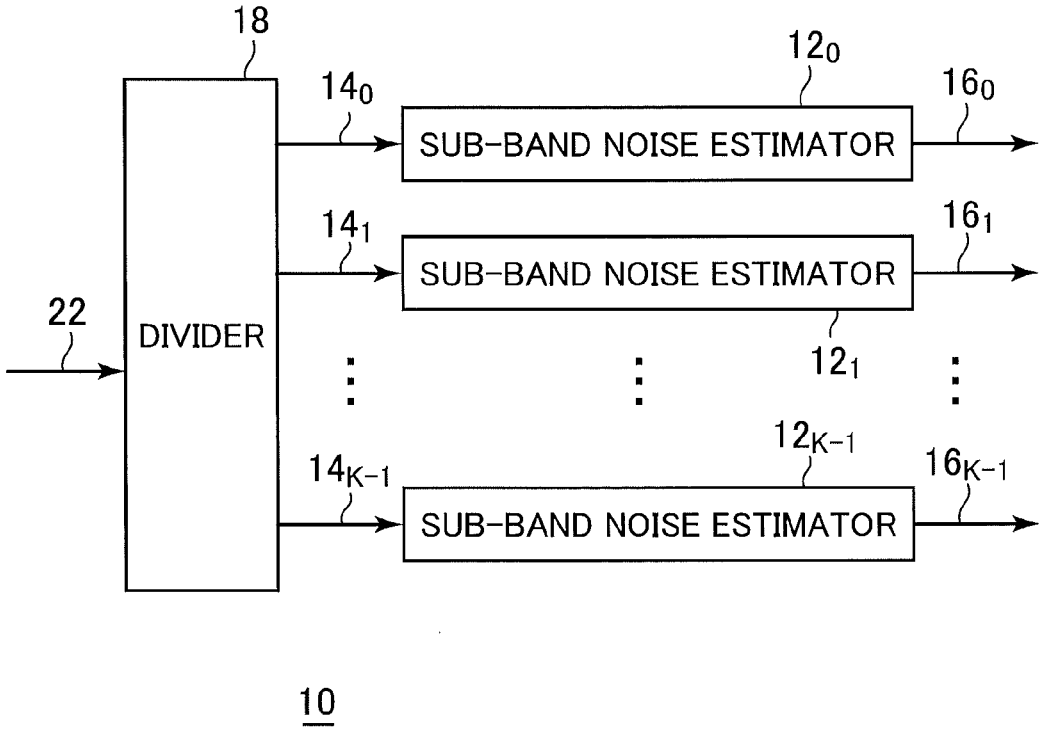
FIG. 2 is a schematic block diagram showing a noise estimator in which a preprocessing device is arranged on the sub-band noise estimators shown in FIG. 1.

Alternatively, the noise estimation apparatus 10 may include a divider 18 for dividing an input signal 22 into a plurality of sub-band signals therein, as shown in FIG. 2. If the input signal 22 not divided into any sub-bands is inputted to the noise estimation apparatus 10 of the embodiment, the input signal 22 is divided into sub-band input signals $\mathbf{14}_0$-$\mathbf{14}_{K-1}$ by the divider 18. The divided sub-band input signals $\mathbf{14}_0$-$\mathbf{14}_{K-1}$ are respectively transmitted to the sub-band noise estimators $\mathbf{12}_0$-$\mathbf{12}_{K-1}$ having the structure similar to those shown in FIG. 1. The divider 18 in FIG. 2 may be any conventional divider. For example, the divider 18 can divide the input signal 22 which is a digital signal into signals $\mathbf{14}_0$-$\mathbf{14}_{K-1}$ with respect to each sub-band in a frame unit. The divider 18 may be adapted to equally or unequally divide the sub-band of the input signal 22. To the unequal division, methods such as a quadrature mirror filter (QMF) and wavelet transformation may be applied.

The sub-band noise estimator 12 includes a power calculator 24 capable of receiving the sub-band input signal 14 from the processor arranged at a stage prior to the noise estimation apparatus 10 or the divider 18 optionally included in the noise estimation apparatus 10. The power calculator 24 calculates the power of the sub-band input signal 14 to derive a resultant sub-band input power 26.

In the power calculator 24, a way of calculating the power is not restricted. For instance, the power calculator 24 can apply a way that a square sum or an absolute value sum of sample values from the present time to a predetermined time before of the sub-band input signal 14 is determined as the sub-band input power 26. Alternatively, another way such that the value of the sub-band input signal 14 is converted to a positive value may be applied as the power calculating way.

The sub-band noise estimator 12 further includes a probability model holder 30 which holds information of a pre-designed probability model relating to the stationarity of the noise (hereinafter, simply called as a "probability model"). The probability model in this embodiment is a model based on the MAP estimation and according to the above-mentioned idea. A design example of the probability model will be specifically described in the following operation description. The probability model held in the probability model holder 30 is indicated by reference numeral 32.

The sub-band noise estimator 12 further includes an a posteriori probability maximizer 34 performing the MAP estimation of the sub-band noise power to derive an instantaneous estimated value 36 of the sub-band noise power, the maximizer 34 being connected with the power calculator 24 and the probability model holder 30.

The sub-band noise estimator 12 further may include a smoother 38 temporally smoothing the instantaneous estimated value 36 of the sub-band noise power to derive the estimated value of the sub-band noise power. The smoother 38 has an input for receiving the instantaneous estimated value 36 of the sub-band noise power from the a posteriori probability maximizer 34. The smoother 38 also has outputs for supplying the signal 16 on the estimated value of the sub-band noise power to a processor (not shown) connected subsequent to the sub-band noise estimator 12 and feeding back information 40 on the estimated value of the sub-band noise power to the a posteriori probability maximizer 34.

The a posteriori probability maximizer 34 can perform the MAP estimation of the sub-band noise power on the basis of the present sub-band input power 26, the estimated value 40 of the past sub-band noise power before a predetermined time (for instance, before some frames) outputted from the smoother 38 and the probability model 32 held by the probability model holder 30. As a result, the maximizer 34 obtains the instantaneous estimated value 36 of the sub-band noise power and transmits it to the smoother 38.

The smoother 38 can adopt various types of smoothing ways. For example, the smoother 38 can determine the averaged value of the instantaneous estimated value 36 of the sub-band noise power in the immediately preceding period, as expressed by the Expression (9). Alternative, the smoother 38 may determine the weighted addition value of the immediately preceding smoothed value and the instantaneous estimated value 36 of the present sub-band noise power, as expressed by the Expression (10). The smoother can adopt any smoothing ways as well as the above-mentioned ways.

Figure 3:
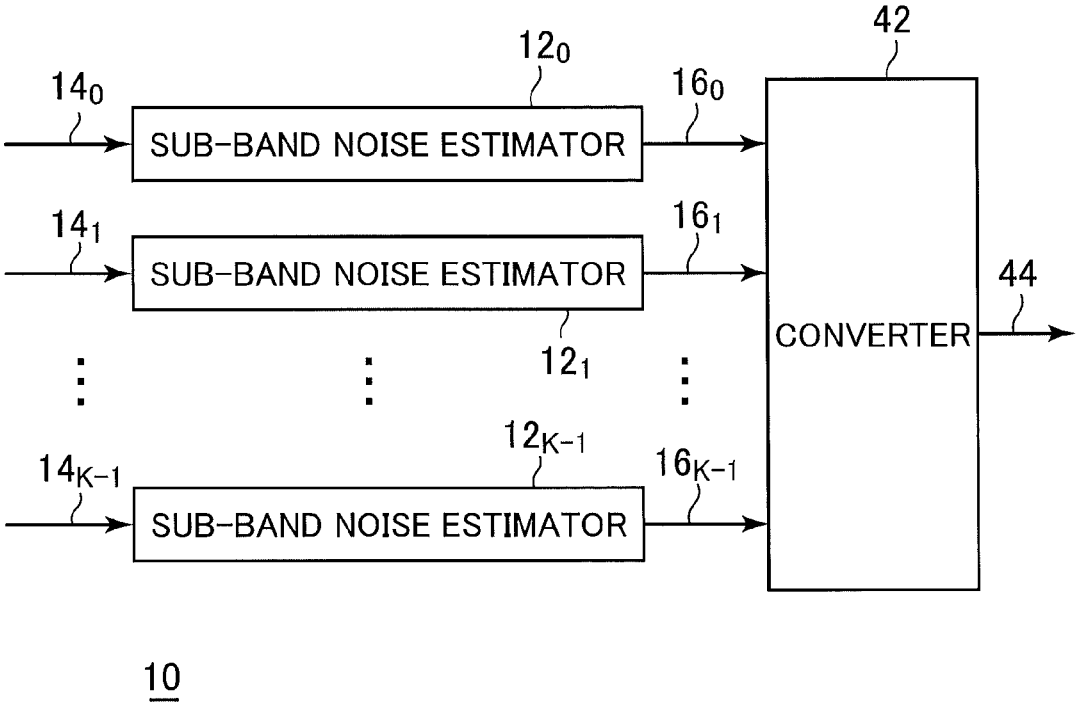
FIG. 3 is a schematic block diagram showing a noise estimator in which a post-processing device is arranged on the sub-band noise estimators shown in FIG. 1.

In the embodiments shown in FIGS. 1 and 2, the noise estimation apparatus 10 is connected with a processor (not shown) arranged at the subsequent stage of the estimation apparatus 10. In this way, the processor can receive and utilize a set of the estimated values $\mathbf{16}_0$-$\mathbf{16}_{K-1}$ of the noise powers in the respective sub-bands, for example, in order to suppress noise. Alternatively, the noise estimation apparatus 10 may include a converter 42 connected with respective outputs $\mathbf{16}_0$-$\mathbf{16}_{K-1}$ of the sub-band noise estimators $\mathbf{12}_0$-$\mathbf{12}_{K-1}$, as shown in FIG. 3. The converter 42 receives the estimated values $\mathbf{16}_0$-$\mathbf{16}_{K-1}$ of the noise powers in the respective sub-bands from the estimators $\mathbf{12}_0$-$\mathbf{12}_{K-1}$ and then integrates them. Furthermore, the converter 42 converts the integrated estimated value to time domain signals 44 and then transmits the converted signals 44 to the processor arranged at the subsequent stage of the estimation apparatus 10.

Figure 4:
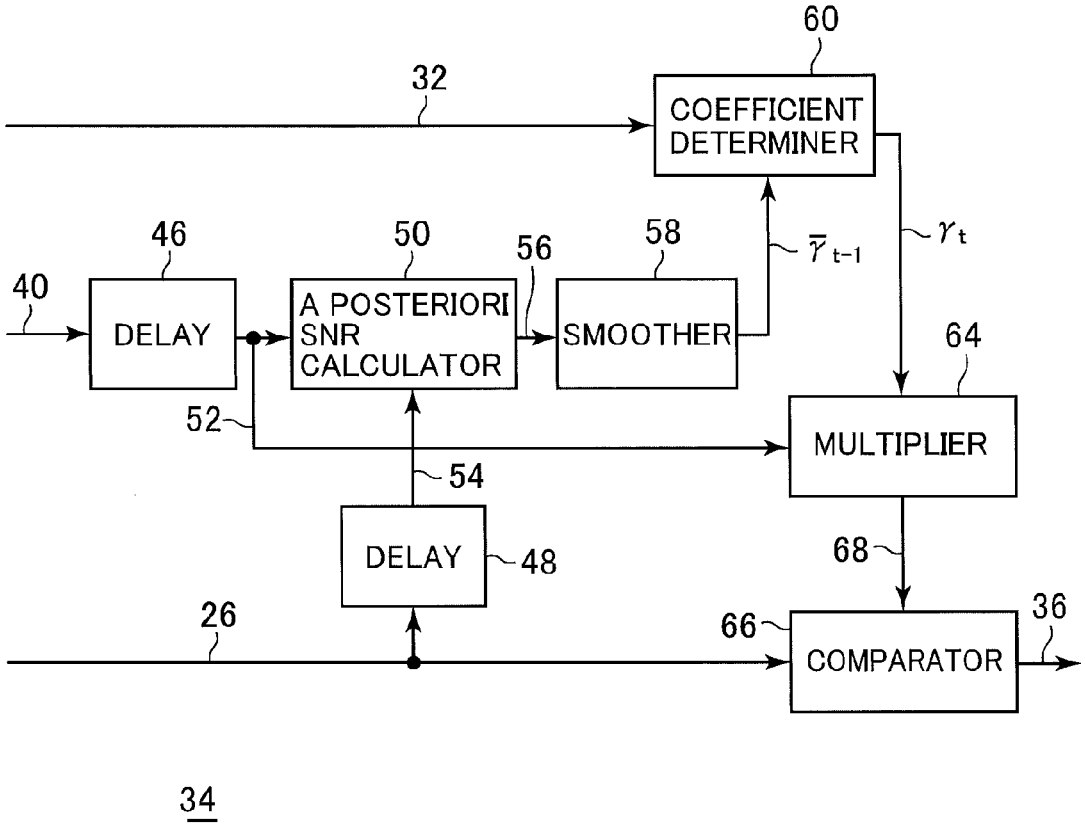
FIG. 4 is a schematic block diagram showing an a posteriori probability maximizer included in the sub-band noise estimator shown in FIG. 1.

FIG. 4 is the functional block diagram showing the detail structure of the a posteriori probability maximizer 34 in the embodiment. The a posteriori probability maximizer 34 includes a delay 46 for delaying the estimated value 40 of the sub-band noise power and a delay 48 for delaying the sub-band input power 26. That is to say, the delays 46 and 48 are connected with the smoother 38 and the power calculator 24, respectively.

The a posteriori probability maximizer 34 also includes an a posteriori SNR calculator 50. On the basis of signals 52 and 54 outputted from the delays 46 and 48, respectively, the a posteriori SNR calculator 50 calculates previous a posteriori SNR 56. That is to say, the a posteriori SNR calculator 50 is connected with outputs of the delays 46 and 48.

The a posteriori probability maximizer 34 may include a smoother 58, connected with an output of the a posteriori SNR calculator 50, for smoothing the previous a posteriori SNR 56. The smoother 58 generates averaged a posteriori SNR $\bar{\gamma}_{t-1}$.

The maximizer 34 further includes a coefficient determiner 60 which is connected with outputs of and the smoother 58 and the probability model holder 30. The coefficient determiner 60 determines a noise amplification coefficient $r_t$ on the basis of the probability model 32 and the averaged a posteriori SNR $\bar{\gamma}_{t-1}$.

The a posteriori probability maximizer 34 also includes a multiplier 64 connected with outputs of the delay 46 and the coefficient determiner 60. The multiplier 64 multiplies the output 52 supplied from the delay 46 by the noise amplification coefficient $r_t$.

The maximizer 34 also includes a comparator 66 connected with outputs of the power calculator 24 and the multiplier 64. The comparator compares the sub-band input power 26 with a resultant 68 multiplied by the multiplier 64.

Hereinafter, the structure and functions of the devices included in the a posteriori probability maximizer 34 will be described in more detail. In the delay 48, the sub-band input power 26 supplied from the power calculator 24 is delayed by a unit processing time, e.g. one frame time. Then, the delayed sub-band input power 54 generated by the delay 48 is transmitted to the a posteriori SNR calculator 50. The sub-band input power 26 is also supplied to the comparator 66 as well as the delay 48.

The estimated value 40 of the sub-band noise power delivered from the smoother 38 is delayed by a unit processing time in the delay 46. Then, the delayed estimated value 52 of the sub-band noise power, generated by the delay 46, is transmitted to the a posteriori SNR calculator 50 and the multiplier 64. In addition, the probability model 32 outputted from the probability model holder 30 is transmitted to the coefficient determiner 60.

In the a posteriori SNR calculator 50, the delayed sub-band input power 54, previously inputted, is divided by the delayed estimated value 52 of the sub-band noise power, previously calculated. Thereby, the previous a posteriori SNR 56 is calculated by the calculator 50. The resultant previous a posteriori SNR 56 is transmitted to the smoother 58.

In the smoother 58, at least one or more past a posteriori SNR (s) given from the a posteriori SNR calculator 50 are stored. Moreover, in the smoother 58, the new given previous a posteriori SNR 56 is temporally-smoothed by using the stored past a posteriori SNR(s). The resultant averaged a posteriori SNR $\bar{\gamma}_{t-1}$ is transmitted to the coefficient determiner 60.

The smoother 58 can apply any temporal-smoothing way without any restriction. As the representative temporal-smoothing way, the smoother 58 can apply a moving average method and a time constant filter or a leak integration. Assuming that the moving average way is applied, if the number of the past a posteriori SNRs used with regard to the present time t is indicated by letter T (T is a positive integer) and if the present a posteriori SNR is represented by $\gamma_t$, the averaged a posteriori SNR $\gamma_{t-1}$ up to the previous time obtained by the averaged moving average method is defined as expressed by following Expression (24):

$$\bar{\gamma}_{t-1} = \frac{1}{T}\sum_{i=t-T}^{t-1} \gamma_i. \qquad \text{Expression (24)}$$

For example, T can be set to 20. If an updating rule expressed by following Expression (25) is used instead of the above Expression (24), the number of the addition and subtraction is reduced by (T−3) calculation to improve efficiency.

$$\bar{\gamma}_{t-1} = \bar{\gamma}_{t-2} + \frac{1}{T}(\gamma_{t-1} - \gamma_{t-T-1}) \qquad \text{Expression (25)}$$

In the coefficient determiner 60, on the basis of the parameters applied for the probability model 32 supplied from the probability model holder 30 (e.g. the distribution parameter $\sigma^2$ and the speed parameter $\lambda_t$ in this embodiment) and the averaged a posteriori SNR $\bar{\gamma}_{t-1}$ supplied from the smoother 58, the noise amplification coefficient $r_t$ is calculated. The resultant noise amplification coefficient $r_t$ is transmitted to the multiplier 64. In this embodiment, the normal distribution is applied as the likelihood function of the probability model. Thus, the noise amplification coefficient $r_t$ is calculated by above Expression (19).

In the multiplier 64, the previous estimated value 52 of the sub-band noise power supplied from the delay 46 is multiplied by the noise amplification coefficient $r_t$ from the coefficient determiner 60 to calculate a provisional estimated value 68 of the sub-band noise power. The resultant provisional estimated value 68 of the sub-band noise power is transmitted from the multiplier 64 to the comparator 66.

In the comparator 66, the present sub-band input power 26 from the power calculator 24 and the provisional estimated value 68 of the sub-band noise power from the multiplier 64 are compared with each other so that smaller one is chosen as the instantaneous estimated value 36 of the sub-band noise power. The resultant instantaneous estimated value 36 of the sub-band noise power is transmitted from the comparator 66 to the smoother 38. That is, the operation as expressed by the Expression (23) is performed by the comparator 66.

As shown in FIG. 1, the smoother 38 stores at least one or more instantaneous estimated values 36 of the sub-band noise powers from the a posteriori probability maximizer 34. By the smoother 38, the stored instantaneous estimated values already stored therein is used to temporally-smooth the new given instantaneous estimated value 36 of the sub-band noise power. The resultant estimated value 16 of the noise power is fed back as the signal 40 to the maximizer 34 and further transmitted as the output 16 of the sub-band noise estimator 12 to the processor arranged at the subsequent stage of the estimator 12. As the temporal-smoothing way of the smoother 38, any optional way may be applied with no restriction. For instance, the moving average method may be applied.

Now, the operation of the noise estimation apparatus 10 of the embodiment will be described in detail. In the embodiment shown in FIG. 1, the sub-band input signals $\mathbf{14}_0$-$\mathbf{14}_{K-1}$ inputted to the noise estimation apparatus 10 is respectively transmitted to the corresponding sub-band noise estimators $\mathbf{12}_0$-$\mathbf{12}_{K-1}$. Alternatively, in the embodiment shown in FIG. 2, the input signal 22 inputted to the noise estimation apparatus 10 is divided into the sub-bands by the sub-band divider 18. The resultant sub-band input signals $\mathbf{14}_0$-$\mathbf{14}_{K-1}$ are respectively transmitted to the corresponding sub-band noise estimators $\mathbf{12}_0$-$\mathbf{12}_{K-1}$.

The noise included in the input signal 14 of each sub-band is estimated by the noise estimator $\mathbf{12}_0$-$\mathbf{12}_{K-1}$ corresponding to the sub-band input signals $\mathbf{14}_0$-$\mathbf{14}_{K-1}$. The resultant estimated values $\mathbf{16}_0$-$\mathbf{16}_{K-1}$ of the sub-band noise powers are obtained and outputted from the estimators $\mathbf{12}_0$-$\mathbf{12}_{K-1}$, respectively.

Each estimator 12 specifically carries out the following processes. The sub-band input signal 14 is transmitted to the power calculator 24, in which the power 26 of the sub-band input signal is calculated. The resultant sub-band input power 26 is transmitted from the calculator 24 to the a posteriori probability maximizer 34.

The pre-designed probability model 32 relating to the stationarity of the noise is held in the probability model holder 30 and transmitted from the holder 30 to the a posteriori probability maximizer 34.

The probability model 32 according to the embodiment includes a functional form of the likelihood function $P(\hat{\gamma}_{t|t-m}|\hat{\gamma}_t)$ and the a priori probability $p(\hat{\gamma}_t|\bar{\gamma}_{t-m})$ as expressed by the Expression (6) and parameters used in these functions. In the embodiment, the time difference m is set to one unit time, i.e. m=1.

If the likelihood function $p(\hat{\gamma}_{t|t-1}|\hat{\gamma}_t)$ is used as a probability density function, the function uses the present a posteriori SNR as a variable to determine a probability that the predictive a posteriori SNR is observed under a condition where the present a posteriori SNR is established. For the likelihood function, an optional probability density function may be chosen so as to be maximized when the predictive a posteriori SNR is equal to the present a posteriori SNR and to be close to zero as the predictive a posteriori SNR is separated from the present a posteriori SNR. In the embodiment, as an example, the normal distribution with the averaged value of zero expressed by the Expression (11) is applied. The normal distribution has the distribution parameter $\sigma^2$, for example, the distribution parameter $\sigma^2$ equal to 42 may be applied in the coefficient determiner 60.

The a priori probability $p(\hat{\gamma}_t|\bar{\gamma}_{t-1})$ is a potential probability that the present a posteriori SNR is observed under the past averaged a posteriori SNR. For the a priori probability, an optional probability density function may be chosen, in a case where the present a posteriori SNR is defined by non-negative, so as to be maximized when the present a posteriori SNR is equals to zero dB and to be close to zero as the present a posteriori SNR is increased. In the embodiment, as an example, the exponential distribution expressed by the Expression (14) is applied in the coefficient determiner 60. The exponential distribution has a speed parameter $\lambda_t$. The speed parameter $\lambda_t$ is varied according to the past averaged a posteriori SNR. As a calculating way of the speed parameter $\lambda_t$, an optional way of satisfying an inverse proportional relationship or a negative proportional relationship to the past averaged a posteriori SNR may be chosen. The parameter calculated by the Expression (15) is applied as an example in the embodiment.

The probability model 32 can be changed according to an optional timing. The change may include an update of the value of distribution parameter $\sigma^2$ and a numerical value in the Expression (15), a change of the calculating way of the speed parameter $\lambda_t$, a change of a functional form of the likelihood function $p(\hat{\gamma}_{t|t-1}|\hat{\gamma}_t)$ and the a priori probability $p(\hat{\gamma}_t|\bar{\gamma}_{t-1})$ and a change of the time difference m.

In the a posteriori probability maximizer 34, the MAP estimation of the noise power is performed on the basis of the present sub-band input power 26, the estimated value of the past sub-band noise power 40 before a predetermined time and the probability model 32 held by the probability model holder 30. The a posteriori probability maximizer 34 supplies the resultant instantaneous estimated value 36 of the noise power to the smoother 38.

In accordance with the embodiment, it is possible to stably estimate stationary sub-band noise power. If the noise estimation apparatus 10 according to the embodiment is incorporated with a noise suppressor, it is possible to restrain distortion of an enhanced speech. This is because the stationary sub-band noise power stably estimated by the noise estimation apparatus 10 is inputted to a noise suppressor to perform the suppression of noise on the basis of the estimated sub-band noise power, the noise suppressor further supplying the obtained sub-band enhanced signal to a signal decoder.

In the following, the noise estimation apparatus 10 and the noise estimating method according to an alternative embodiment of the invention will be described with reference to the drawings.

The noise estimation apparatus 10 of the alternative embodiment also includes the power calculator 24, the probability model holder 30 and the a posteriori probability maximizer 34, similar to the previous embodiment shown in FIGS. 1 and 2. Furthermore, the noise estimation apparatus 10 of the alternative embodiment may include the smoother 38 similar to the embodiment shown in FIGS. 1 and 2.

Figure 5:
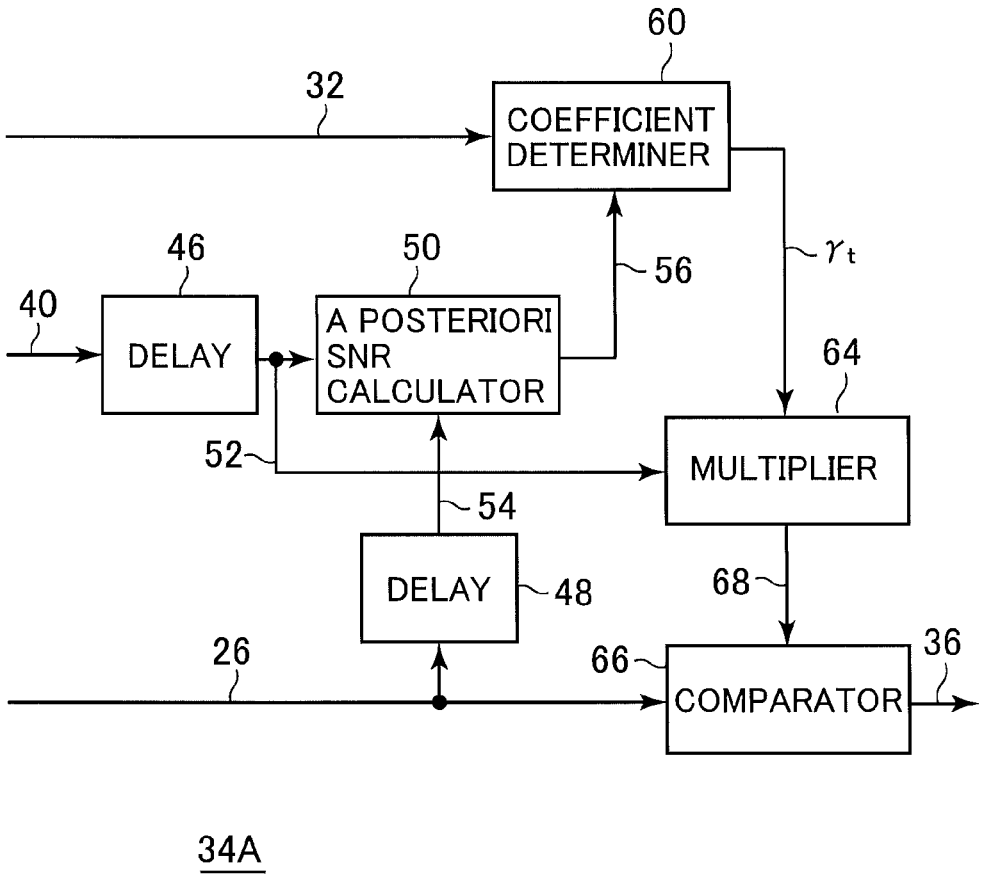
FIG. 5 is a schematic block diagram showing another posteriori probability maximizer included in the sub-band noise estimator shown in FIG. 1.

In the alternative embodiment, the a posteriori probability maximizer 34 has an internal structure different from that in the previous embodiment shown in FIGS. 1 and 2. Hereinafter, the a posteriori probability maximizer in the alternative embodiment is indicated by reference numeral 34A and will be described with reference to FIG. 5. In FIG. 5, constituent elements similar to those in FIG. 4 are illustrated by same reference numerals.

FIG. 5 is the functional block diagram showing the detail structure of the a posteriori probability maximizer 34A of the alternative embodiment. As shown in FIG. 5, the a posteriori probability maximizer 34A includes the sub-band noise power estimated value delay 46 for delaying the estimated value 40 of the sub-band noise power, the sub-band input power delay 48 for delaying the sub-band input power 26, the a posteriori SNR calculator 50, the coefficient determiner 60, the multiplier 64 and the comparator 66.

That is, the a posteriori probability maximizer 34A in this embodiment does not include the smoother 58 in comparison with that in the previous embodiment. Therefore, in this embodiment the a posteriori SNR calculator 50 directly supplies the previous a posteriori SNR 56 to the coefficient determiner 60, which then determines the noise amplification coefficient $r_t$ by using the previous a posteriori SNR 56 as well as the probability model 32. Except for the above-mentioned point, the estimator 12 in the alternative embodiment is configured similarly to that in the previous embodiment.

The operation without temporally-smoothing the previous a posteriori SNR 56 is equivalent to execution of the Expression (24) or (25) by substituting "1" for the value "T" for operating temporal-smoothing as described about the previous embodiment. This means that the previous a posteriori SNR 56 is representatively selected as the averaged a posteriori SNR obtained up to the previous time. The averaged a posteriori SNR is one of parameters used for inferring the present sound collection environment. Omitting the temporal-smoothing makes information quantity reduce and estimation accuracy of as the estimated value of the sound collection environment deteriorated. However, since estimation error caused by the deterioration of the estimation accuracy is reduced by the latter smoother 38, there is little influence. On the contrary, the omission of the temporal-smoothing causes advantageous of decreasing processing quantity and reducing resource.

In accordance with the alternative embodiment, it is possible to stably estimate the stationary noise power by the little processing quantity and resource.

In addition to the above-mentioned embodiments, the present invention may be also applied to further alternative embodiments illustrated as follows.

In the above-mentioned embodiments, the respective probability model holders 30 in the sub-band noise estimators $12_0$-$12_{K-1}$ holds the similar probability model 32. However, in another embodiment, information on the probability model 32 may be varied with respect to each sub-band assigned for the sub-band noise estimators $12_0$-$12_{K-1}$. For instance, if the normal distribution is applied to the likelihood function, the distribution parameter $\sigma^2$ may be determined by respective different values for the sub-bands assigned for the respective estimators $12_0$-$12_{K-1}$. Furthermore, the application of the normal distribution or the generalized normal distribution can be determined as the likelihood function with respect to each sub-band assigned for the estimators $12_0$-$12_{K-1}$.

If the exponential distribution is applied to the probability density function of the a priori probability, the parameter $\lambda_t$ may be determined by respective different values with respect to each sub-band assigned for the estimators $12_0$-$12_{K-1}$. Moreover, the probability density function of the a priori probability for every sub-band assigned for the estimators 12 may be differently set about whether the exponential distribution, gamma distribution, one-sided normal distribution or one-sided generalized normal distribution is applied.

In the above-mentioned embodiments, the probability model holder 30 in the estimator 12 holds one probability model information. However, the holder 30 may hold a plurality of probability model information so as to allow a choice of the information to be used. For instance, the probability model information to be used may be decided according to the choice operation of a user.

Alternatively, the probability model information to be used may be decided by calculating a plurality of statistics predetermined about the sub-band input power and accessing, on the basis of the calculated statistics, a table mapping the combination of steps to which the respective statistics belong, in short, application condition, on the probability model information.

In the above embodiments, the noise estimation in the above-mentioned embodiments is performed for all the divided sub-bands. However, only a part of the divided sub-bands may be subject to the noise estimation. For instance, the divided sub-band being subject to the noise estimation may be chosen by the user from among the high frequency sub-band, low frequency sub-band, intermediate frequency sub-band or all the sub-bands.

Figure 6:
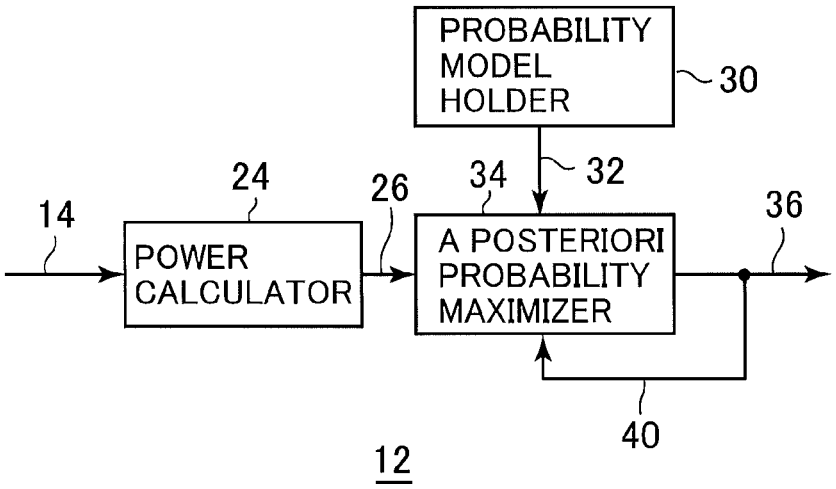
FIG. 6 is a schematic block diagram showing a sub-band noise estimator included in a noise estimator according to alternative embodiment of the present invention.

In the embodiment shown in FIG. 1, the sub-band noise estimator 12 includes the smoother 38. However, as shown in FIG. 6, the sub-band noise estimator 12 in the noise estimation apparatus 10 may have the structure without the smoother 38. In the Figure, a single sub-band noise estimator 12 is shown as a matter of convenience. However, needless to say, the apparatus 10 in this embodiment can includes a plurality of sub-band noise estimators 12. In this embodiment, the a posteriori probability maximizer 34 directly supplies the instantaneous estimated value 36 of the sub-band noise power as the output signal on the estimated value of the sub-band noise power to a processor arranged at the subsequent stage of the estimator 12. Furthermore, the estimated value 36 is fed back to the estimator 12 itself. More specifically, the instantaneous estimated value 36 can be supplied on a communication line 72 to the delay 46 in the a posteriori probability maximizer 34. The delay 46 can delay the input value 36 to use the delayed value for the calculation the next instantaneous estimated value of the sub-band noise power in the a posteriori probability maximizer 34.

Figure 7:
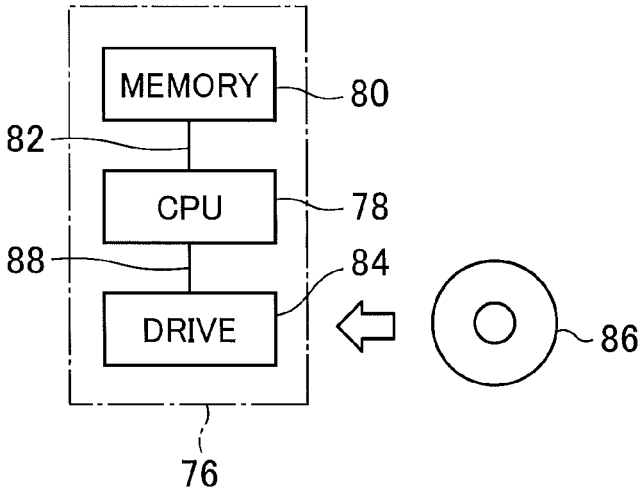
FIG. 7 is a schematic block program of a computer capable of serving as a noise estimation apparatus in accordance with embodiments of the invention or at least one sub-band noise estimator included in the noise estimator according to embodiments of the present invention.

The sub-band noise estimators 12 and the noise estimation apparatus 10 may consist of hardware. Otherwise, as shown in FIG. 7, those may be actualized by using a computer 76 including a central processing unit (CPU) 78 and software, such as a sub-band noise estimating program and a noise estimating program, and executed by the CPU 78. In case of the embodiment wherein the invention is implemented by the computer 76 shown in FIG. 7, the computer 76 includes a central processing unit (CPU) 78 for executing the program, a memory 80, which is connected with the CPU 78 via a communication line 82, for storing various programs and information, and other various devices, not shown. The computer 76 may further includes a drive 84 for reading in data and program stored in a data storage medium 86. The drive 84 can be directly or indirectly connected with the CPU 78 and the memory 80 via a communication line 88 so that the CPU 78 can control reading operations of the program stored in the data storage medium 86. The data storage medium 86 stores a program for letting the computer 76 serve as the noise estimation apparatus 10 in accordance with the embodiment of the invention or the sub-band noise estimator (s) 12 included in the embodiment of the invention. The data storage medium 86 can be in form of every known storage medium, more specifically a compact disk (CD), a digital versatile disk (DVD), a magnetic disk, a magnetic optical disk, a flash memory or the like.

Regardless of the present invention being implemented by the hardware or the software, the estimation apparatus 10 and estimating device 12 can be functionally represented by the similar block diagram.

The entire disclosure of Japanese patent application No. 2014-023591 filed on Feb. 10, 2014, including the specification, claims, accompanying drawings and abstract of the disclosure, is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

What is claim is:

1. A noise estimation apparatus of estimating a noise included in an input signal, comprising:

at least one sub-band noise estimator estimating a noise included in a sub-band input signal, obtained by dividing the input signal by sub-bands; wherein said sub-band noise estimator comprises:

a power calculator calculating a sub-band input power of the sub-band input signal;

a probability model holder holding information on probability model obtained by modelizing stationarity of the noise; and an a posteriori probability maximizer calculating an instantaneous estimated value of a sub-band noise power on a basis of the sub-band input power, an estimated value of the sub-band noise power outputted from said sub-band noise estimator and the information on the probability model held in said probability model holder, so as to maximize a posteriori probability of the sub-band noise power, and wherein the information on the probability model includes information on:

a likelihood function with regard to a posteriori signal-to-noise ratio (SNR) on a basis of a predictive a posteriori SNR; and a priori probability of the a posteriori SNR under a condition where averaged a posteriori SNR is established.

2. The noise estimation apparatus in accordance with claim 1, wherein said sub-band noise estimator further comprises a smoother temporally-smoothing the instantaneous estimated value of the sub-band noise power to derive the estimated value of the sub-band noise power.

3. The noise estimation apparatus in accordance with claim 1, wherein the a posteriori SNR is a value determined by dividing the sub-band input power by an estimated value of the sub-band noise power at a same time as the sub-band input power, the predictive a posteriori SNR is a value determined by dividing the sub-band input power by the estimated value of the past sub-band noise power before a predetermined time; and wherein the averaged a posteriori SNR is a temporally-smoothed a posteriori SNR calculated from at least two or more past a posteriori SNRs.

4. The noise estimation apparatus in accordance with claim 1, wherein the a posteriori SNR is a value determined by dividing the sub-band input power by an estimated value of the sub-band noise power at a same time as the sub-band input power, the predictive a posteriori SNR is a value determined by dividing the sub-band input power by the estimated value of the past sub-band noise power before a predetermined time, and wherein the averaged a posteriori SNR is a single past posteriori SNR before a predetermined time.

5. The noise estimation apparatus in accordance with claim 1, wherein the likelihood function takes a maximum value when the a posteriori SNR is equal to the predictive posteriori SNR and wherein the likelihood function converges to zero as a difference between the a posteriori SNR and the predictive a posteriori SNR is increased.

6. The noise estimation apparatus in accordance with claim 5, wherein, as the likelihood function, a normal distribution or a generalized normal distribution is applied.

7. The noise estimation apparatus in accordance with claim 1, wherein, in a case where the a posteriori SNR is defined as non-negative, the a priori probability is maximized when the a posteriori SNR is equals to zero and converges to zero as the a posteriori SNR is increased.

8. The noise estimation apparatus in accordance with claim 7, wherein, as the a priori probability, an exponential distribution is applied.

9. The noise estimation apparatus in accordance with claim 8, wherein a speed parameter of the exponential distribution has a negative proportional relationship or an inverse proportional relationship to the averaged a posteriori SNR.

10. The noise estimation apparatus in accordance with claim 1, wherein said a posteriori probability maximizer comprises:

a first delay delaying the estimated value of the sub-band noise power;

a second delay delaying the sub-band input power;

an a posteriori SNR calculator calculating the a posteriori SNR on a basis of the estimated value of the sub-band noise power delayed by the first delay and the sub-band input power delayed by the second delay;

a smoother calculating the averaged a posteriori SNR by temporally-smoothing the a posteriori SNR;

a coefficient determiner determining a noise amplification coefficient on a basis of the information on probability model and the averaged a posteriori SNR;

a multiplier multiplying the delayed estimated value of the sub-band noise power by the noise amplification coefficient to derive a provisional estimated value of the sub-band noise power; and a comparator comparing the provisional estimated value of the sub-band noise power with the sub-band input power to selectively output an instantaneous estimated value of the sub-band noise power.

11. The noise estimation apparatus in accordance with claim 1, wherein said a posteriori probability maximizer comprises:

a first delay delaying the estimated value of the sub-band noise power;

a second delay delaying the sub-band input power;

an a posteriori SNR calculator calculating the a posteriori SNR on a basis of the estimated value of the sub-band noise power delayed by said first delay and the sub-band input power delayed by said second delay;

a coefficient determiner determining a noise amplification coefficient on a basis of the information on probability model and the a posteriori SNR;

a multiplier multiplying the delayed estimated value of the sub-band noise power by the noise amplification coefficient to derive a provisional estimated value of the sub-band noise power; and a comparator comparing the provisional estimated value of the sub-band noise power with the sub-band input power to selectively output an instantaneous estimated value of the sub-band noise power.

12. A noise estimating method of estimating a noise included in an input signal, comprising a step of estimating a noise included in a sub-band input signal obtained by dividing the input signal by sub-bands, wherein said step of estimating the noise further comprises sub-steps of:

calculating a sub-band input power of the sub-band input signal;

holding information on probability model obtained by modelizing stationarity of the noise, the information on the probability model including information on: a likelihood function with regard to a posteriori signal-to-noise ratio (SNR) on a basis of predictive a posteriori SNR; and a priori probability of the a posteriori SNR under a condition where averaged a posteriori SNR is established; and calculating an instantaneous estimated value of a sub-band noise power on a basis of the sub-band input power, an estimated value of the sub-band noise power and the held information on the probability model, so as to maximize a posteriori probability of the sub-band noise power.

13. The noise estimating method in accordance with claim 12, wherein said step further comprises a smoothing sub-step of temporally-smoothing the instantaneous estimated value of the sub-band noise power to derive the estimated value of the sub-band noise power.

14. The noise estimating method in accordance with claim 12, wherein said sub-step of calculating the instantaneous estimated value of the sub-band noise power further comprises steps of:

delaying the estimated value of the sub-band noise power;

delaying the sub-band input power;

calculating the a posteriori SNR on a basis of the delayed estimated value of the sub-band noise power and the delayed sub-band input power;

calculating the averaged a posteriori SNR by temporally-smoothing the a posteriori SNR;

determining a noise amplification coefficient on a basis of the information on probability model and the averaged a posteriori SNR;

multiplying the delayed estimated value of the sub-band noise power by the noise amplification coefficient to derive a provisional estimated value of the sub-band noise power; and comparing the provisional estimated value of the sub-band noise power with the sub-band input power to selectively output the instantaneous estimated value of the sub-band noise power.

15. The noise estimating method in accordance with claim 12, wherein said sub-step of calculating the instantaneous estimated value of the sub-band noise power further comprises steps of:

delaying the estimated value of the sub-band noise power;

delaying the sub-band input power;

calculating the a posteriori SNR on a basis of the delayed estimated value of the sub-band noise power and the delayed sub-band input power;

determining a noise amplification coefficient on a basis of the information on probability model and the a posteriori SNR;

multiplying the delayed estimated value of the sub-band noise power by the noise amplification coefficient to derive a provisional estimated value of the sub-band noise power; and comparing the provisional estimated value of the sub-band noise power with the sub-band input power to selectively output the instantaneous estimated value of the sub-band noise power.

16. A non-transitory computer-readable medium storing a noise estimating program, when executed by a computer, causing the computer to serve as at least one sub-band noise estimator and to perform a step of estimating a noise included in a sub-band input signal, obtained by dividing an input signal inputted to the computer by sub-bands;

wherein the noise estimating step further comprises sub-steps of:

calculating a sub-band input power of the sub-band input signal;

holding information on probability model obtained by modelizing stationarity of the noise; and calculating an instantaneous estimated value of a sub-band noise power on a basis of the sub-band input power, an estimated value of the sub-band noise power outputted from the sub-band noise estimating step and the held information on the probability model, so as to maximize a posteriori probability of the sub-band noise power, and wherein the held information on the probability model includes information on:

a likelihood function with regard to a posteriori signal-to-noise ratio (SNR) on a basis of predictive a posteriori SNR; and a priori probability of a posteriori SNR under a condition where averaged a posteriori SNR is established.

17. The computer-readable medium in accordance with claim 16, wherein said noise estimating step further comprising step of temporally-smoothing the instantaneous estimated value of the sub-band noise power to derive the estimated value of the sub-band noise power.

18. The computer-readable medium in accordance with claim 16, wherein the sub-step of calculating an instantaneous estimated value of a sub-band noise power further comprises steps of:

delaying the estimated value of the sub-band noise power;

delaying the sub-band input power;

calculating the a posteriori SNR on a basis of the delayed estimated value of the sub-band noise power and the delayed sub-band input power;

calculating the averaged a posteriori SNR by temporally-smoothing the a posteriori SNR;

determining a noise amplification coefficient on a basis of the information on probability model and the averaged a posteriori SNR;

multiplying the delayed estimated value of the sub-band noise power by the noise amplification coefficient to derive a provisional estimated value of the sub-band noise power; and comparing the provisional estimated value of the sub-band noise power with the sub-band input power to selectively output the instantaneous estimated value of a sub-band noise power.

19. The computer-readable medium in accordance with claim 16, wherein said sub-step of calculating the instantaneous estimated value of a sub-band noise power further comprises steps of:

delaying the estimated value of the sub-band noise power;

delaying the sub-band input power;

calculating the a posteriori SNR on a basis of the delayed estimated value of the sub-band noise power and the delayed sub-band input power;

determining a noise amplification coefficient on a basis of the information on probability model and the a posteriori SNR;

multiplying the delayed estimated value of the sub-band noise power by the noise amplification coefficient to derive a provisional estimated value of the sub-band noise power; and comparing the provisional estimated value of the sub-band noise power with the sub-band input power to selectively output the instantaneous estimated value of a sub-band noise power.

* * * * *